US009031682B2

(12) United States Patent
Tanaka et al.

(10) Patent No.: US 9,031,682 B2
(45) Date of Patent: May 12, 2015

(54) EYEGLASS LENS SUPPLYING SYSTEM

(75) Inventors: Motoshi Tanaka, Aichi (JP); Yuya Nakako, Aichi (JP)

(73) Assignee: Nidek Co., Ltd., Aichi (JP)

( * ) Notice: Subject to any disclaimer, the term of this patent is extended or adjusted under 35 U.S.C. 154(b) by 545 days.

(21) Appl. No.: 13/397,046

(22) Filed: Feb. 15, 2012

(65) Prior Publication Data

US 2012/0209416 A1 Aug. 16, 2012

(30) Foreign Application Priority Data

Feb. 16, 2011 (JP) ..... 2011-031459
Feb. 10, 2012 (JP) ..... 2012-027507

(51) Int. Cl.

| | |
|---|---|
| ***G06F 19/00*** | (2011.01) |
| ***B24B 9/14*** | (2006.01) |
| ***B24B 13/00*** | (2006.01) |
| ***B24B 41/00*** | (2006.01) |
| *G06F 7/00* | (2006.01) |

(52) U.S. Cl.

CPC ..... *B24B 9/148* (2013.01); *B24B 9/146* (2013.01); *B24B 13/0031* (2013.01); *B24B 41/005* (2013.01)

(58) Field of Classification Search

CPC .... B24B 9/146; B24B 1/005; B24B 13/0031; B24B 9/148

USPC ..... 700/112–116, 228–230; 198/300–301, 198/307.1, 339.1, 340, 347.1, 348; 425/130, 135

See application file for complete search history.

(56) References Cited

U.S. PATENT DOCUMENTS

| | | | | |
|---|---|---|---|---|
| 4,662,119 | A | 5/1987 | Kojima | |
| 5,555,504 | A * | 9/1996 | Lepper et al. | 700/115 |
| 5,578,331 | A * | 11/1996 | Martin et al. | 425/445 |
| 5,649,410 | A * | 7/1997 | Martin et al. | 53/474 |
| 6,159,072 | A | 12/2000 | Shibata | |
| 6,464,484 | B1 * | 10/2002 | Powers et al. | 425/143 |
| 6,609,041 | B1 * | 8/2003 | Sanka et al. | 700/115 |

(Continued)

FOREIGN PATENT DOCUMENTS

| | | | |
|---|---|---|---|
| DE | 19815728 | A1 | 10/1999 |
| EP | 0175431 | A2 | 3/1986 |

(Continued)

OTHER PUBLICATIONS

Communication from the European Patent Office issued Jul. 17, 2014 in a counterpart European Application No. 12001021.0.

*Primary Examiner* — Ramesh Patel
(74) *Attorney, Agent, or Firm* — Sughrue Mion, PLLC

(57) ABSTRACT

An eyeglass lens supplying system for supplying an eyeglass lens to a plurality of eyeglass lens processing apparatus includes: a plurality of conveyer line units, each of which includes: at least one conveyer line conveying a tray; a tray moving unit separating at least two trays from the conveyer line to move the trays to standby positions, and put the tray on the conveyer line; and a control unit obtaining processing information from a host computer; a carrying-in conveyer line connected to the conveyer line of the conveyer line unit; a carrying-out conveyer line connected to the conveyer line of the conveyer line unit; a main control unit communicating with each of the control units, and determines the processing apparatus to process the lens in the tray on the carrying-in conveyer unit, or determines the conveyer line unit to convey the tray on the carrying-in conveyer unit.

7 Claims, 7 Drawing Sheets

(56) References Cited

U.S. PATENT DOCUMENTS

| | | | | |
|---|---|---|---|---|
| 6,790,024 | B2 * | 9/2004 | Foreman | 425/162 |
| 6,974,298 | B2 * | 12/2005 | Tanaka | 414/788.1 |
| 7,051,290 | B2 * | 5/2006 | Foreman et al. | 715/810 |
| 7,090,559 | B2 * | 8/2006 | Vulich et al. | 451/5 |
| 7,195,538 | B2 * | 3/2007 | Tanaka | 451/5 |
| 7,371,151 | B2 * | 5/2008 | Shibata et al. | 451/11 |
| 7,854,866 | B2 * | 12/2010 | Atkinson et al. | 264/2.6 |
| 8,490,781 | B2 * | 7/2013 | Meschenmoser et al. | 206/5 |
| 2002/0034921 | A1 * | 3/2002 | Mizuno et al. | 451/5 |
| 2004/0018801 | A1 | 1/2004 | Mizun et al. | |
| 2004/0029496 | A1 | 2/2004 | Mizuno et al. | |
| 2004/0231958 | A1 | 11/2004 | Miyazawa et al. | |
| 2005/0077639 | A1 * | 4/2005 | Foreman et al. | 264/1.38 |
| 2007/0035050 | A1 * | 2/2007 | Rogers | 264/1.32 |
| 2008/0284049 | A1 * | 11/2008 | Atkinson et al. | 264/2.6 |
| 2009/0012642 | A1 | 1/2009 | Mertens et al. | |
| 2010/0136227 | A1 * | 6/2010 | Kirchoff et al. | 427/164 |
| 2010/0230838 | A1 * | 9/2010 | Rogers | 264/1.38 |

FOREIGN PATENT DOCUMENTS

| | | | |
|---|---|---|---|
| EP | 1457290 | A1 | 9/2004 |
| JP | 10-138107 | A | 5/1998 |
| JP | 2004-34167 | A | 5/1998 |
| JP | 2000-94283 | A | 4/2000 |
| JP | 2002-036083 | A | 2/2002 |
| JP | 2004-34166 | A | 2/2004 |
| JP | 2006-167912 | A | 6/2006 |
| JP | 2007-268706 | A | 10/2007 |
| WO | 2005/095049 | A1 | 10/2005 |

* cited by examiner

EYEGLASS LENS SUPPLYING SYSTEM

BACKGROUND

The present invention relates an eyeglass lens supplying system for supplying an eyeglass lens to a plurality of eyeglass lens peripheral edge processing apparatuses.

In an eyeglass lens peripheral edge processing plant, a system is adopted in which a plurality of lens peripheral edge processing apparatuses are arranged, and the tray with the lens placed thereon is automatically transported to the lens peripheral edge processing apparatus by a conveyor line such as a belt (for example, see JP-A-2000-94283(US2002/034921A1). The lens in the tray transported to the processing apparatus by the conveyor line is moved to the processing apparatus by a robot. The lens processed by the processing apparatus is returned to the tray on the conveyor line by the robot again. The tray with the processed lens placed thereon is transported to a downstream side by the conveyor line.

SUMMARY

In a lens processing plant of a large scale for processing eyeglass lenses in large quantities, a plurality of processing apparatus is arranged, and a system of a conveyor line for transporting a tray receiving a lens to each processing apparatus is established. The system of the conveyor line of the related art using a plurality of processing apparatus was configured, for example, as below.

An individual conveyor line corresponding to the processing apparatus was installed in parallel (or in a branched manner) with respect to a tray carrying-in main conveyor line. Furthermore, separately from the tray carrying-in main conveyor line, a tray carrying-out main conveyor line was provided. The tray carrying-out main conveyor line was provided in parallel with respect to the tray carrying-in main conveyor line. In the case of this configuration, the tray transported in the main conveyor line is distributively transported to each individual conveyor line by a tray distributing mechanism which is prepared for the number of the individual conveyor lines. The lens placed on the tray on the individual conveyor line is moved to the processing apparatus by the robot. The lens processed in the processing apparatus is returned to the tray on the individual conveyor line by the robot again. The tray with the processed lens placed thereon joins the carrying-out main conveyor line by the individual conveyor line.

In a configuration of the conveyor line, there is a need for separate main conveyor lines for carrying in and carrying out the tray, a distributing mechanism prepared for the number of the individual conveyor lines, and a joining mechanism for joining the tray on each individual conveyor line to the tray carrying-out conveyor line. For this reason, a size of the entire system of the conveyor line is increased. Furthermore, there is also a need for a large space for the entire system for each individual conveyor line arranged in parallel. Furthermore, the respective numbers of the processing apparatus, the robot moving the lens, the distributing mechanism, and the joining mechanism are varied according to a desire of a user who uses the lens supplying system, and the arrangements of each unit are also varied according to a desire of a user. For this reason, the control program (control software) combining the respective units becomes customized according to the specifications desired by a user, a development time for the control program is taken, and the cost is increased.

In view of the problems of the related art mentioned above, a technical object of the present invention is to provide an economically advantageous eyeglass lens supplying system which is able to suppress an increase in size of the system.

In order to solve the problem, the present invention includes a configuration as below.

(1) An eyeglass lens supplying system for supplying an eyeglass lens to a plurality of eyeglass lens processing apparatus comprising:

a plurality of conveyer line units, each of which includes:

at least one conveyer line configured to convey a tray in which the lens is put;

a base on which at least one processing apparatus and the conveyer line are disposed;

a tray moving unit configured to separate at least two trays from the conveyer line for one processing apparatus to move the trays to standby positions, respectively, and put the tray in which processed lens is put on the conveyer line;

a robot configured to supply the lens in the tray at the standby position to the processing apparatus and return the processed lens to the tray; and a control unit configured to obtain identification information to obtain processing information from a host computer;

a carrying-in conveyer line connected to the conveyer line of the conveyer line unit which is located at a uppermost stream side;

a carrying-out conveyer line connected to the conveyer line of the conveyer line unit which is located at a downmost streamside;

a main control unit configured to communicates with each of the control units, and determines the processing apparatus to process the lens in the tray on the carrying-in conveyer unit, or determines the conveyer line unit to convey the tray on the carrying-in conveyer unit, wherein the conveyor lines of the plurality of conveyer line units are connected so as to form substantially one conveyer line when the plurality of conveyer line units are arranged.

(2) The eyeglass lens supplying system according to (1), wherein if the standby position can receive the tray, the corresponding control unit sends a signal for request the tray to the main control unit, and if receiving the request signal, the main control unit determines the conveyer line unit as a carrying-out destination of the tray and supplies the tray to the conveyer line of the conveyer line unit at the uppermost stream side.

(3) The eyeglass lens supplying system according to (2) further comprising a stopper unit configured to stop conveying of the tray by the carrying-in conveyer unit, the stopper unit is disposed at the upstream side of the uppermost upper stream side conveyer line, wherein when receiving the request signal, the main control unit cancels stopping of the stopper unit and supplies the tray to the uppermost stream side conveyer line.

(4) The eyeglass lens supplying system according to (2), wherein a first reader for reading the identification information of the tray on the carrying-in conveyer line is provided at an upstream side of the conveyer line of the uppermost stream side conveyer line unit, a second reader for reading the identification information of the conveyed tray is provided at each of the conveyer line units, the main control unit sends the identification information read by the first reader to the control unit of the conveyer line unit which is determined as the carrying-out destination, the control unit of each of the conveyer lint unit:

operates the tray moving unit to moves the tray to the standby position if the identification information sent from the main control unit matches with the identification information read by the second reader; and does not operate the tray moving unit and send the tray to the downstream side conveyer line if the identification information sent from the main control unit does not matches with the identification information read by the second reader.

(5) The eyeglass lens supplying system according to (1), wherein if the robot returns the processed lens to the tray at the standby position, the robot supplies the lens in the tray at the other standby position to the processing apparatus, if the robot returns the processed lens to the tray, the tray moving unit puts the tray on the conveyer line, if the standby position can receive the tray, the corresponding control unit sends a signal for request the tray to the main control unit, and if receiving the request signal, the main control unit determines the conveyer line unit as a carrying-out destination of the tray and supplies the tray to the conveyer line of the conveyer line unit at the uppermost stream side.

(6) The eyeglass lens supplying system according (1), wherein the conveyer line of each of the conveyer line units includes a first conveyer line for conveying the tray in which the unprocessed lens is put and a second conveyer line for conveying the tray in which the processed lens in put, and the tray moving unit put the tray in which the processed lens is put on the second conveyer line.

According to the present invention, it is possible to build an eyeglass lens supplying system which suppresses an increase in size of the lens supplying system and an increase in installation space and is economically advantageous.

DESCRIPTION OF EXEMPLARY EMBODIMENTS

Figure 1:
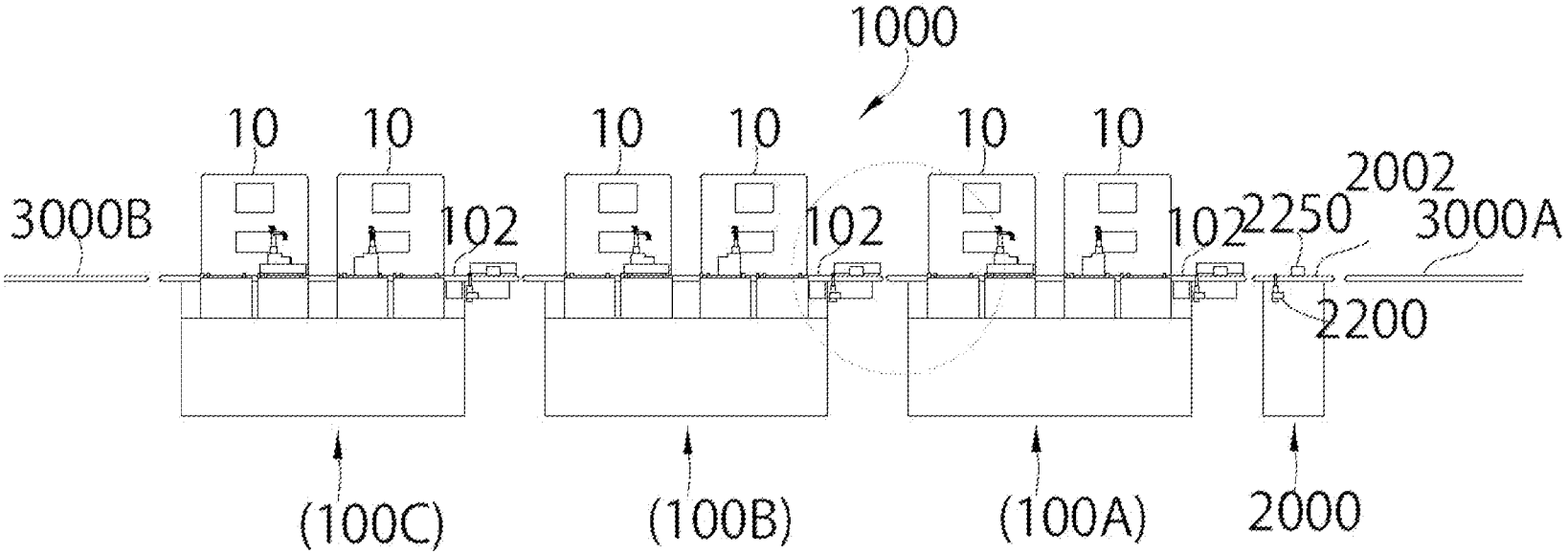
FIG. 1 is an overall schematic configuration of an eyeglass lens processing apparatus according to the present invention.

Hereinafter, an exemplary embodiment of the present invention will be described based on the drawings. FIG. 1 is an overall schematic diagram of an eyeglass lens supplying system according to the present invention.

An eyeglass lens supplying system 1000 includes a plurality of individual conveyor line units 100 (hereinafter RCL units) having at least one belt type conveyor line 102 for transporting a tray TR. Each RCL unit 100 includes a base 101 and at least one eyeglass lens peripheral edge processing apparatus 10 is placed in on the base 101 in response to the conveyor line 102. The processing apparatus 10 has a lens chuck shaft which holds an eyeglass lens LE, and a peripheral edge processing tool which processes the peripheral edge of the lens LE, and controls the relative movement between the lens LE and the circumferential processing tool based on an input bead form to process the peripheral edge of the lens LE. Since the configuration of the processing apparatus 10 is disclosed as is well known in JP-2004-34167 or the like, the description thereof will be omitted.

A pair of left and right eyeglass lenses LE (see FIG. 5) is received in the tray TR. In FIG. 1, the system 1000 includes three RCL units 100 (hereinafter, when distinguishing three RCL units 100, reference numerals 100A, 100B, and 100C are used). The respective RCL units 100 are connected to each other in series. That is, by connecting conveyor lines 102 included in each RCL unit 100 to each other in series, the conveyor lines 102 are connected so as to form substantially one conveyer line when the plurality of conveyer line units 100 are arranged. The tray TR is transported from a conveyor line 102 included in a RCL unit 100A of an upstream side (a right side of FIG. 1) to a conveyor line 102 included in a RCL unit 100C of a downstream side (a left side of FIG. 1).

On the upstream side of the RCL unit 100A, a carrying-in conveyor line 3000A for carrying in the tray TR with a non-processed lens LE placed thereon is arranged. On the downstream side of the RCL unit 100C, a carrying-out conveyor line 3000B for carrying out the tray TR with a processed lens LE placed thereon is arranged. Furthermore, a distributing unit 2000 having a conveyor line 2002 is arranged between the RCL unit 100A and the carrying-in conveyor line 3000A. That is, the distributing unit 2000 is provided at an upstream side of the RCL unit 100A which is located at the uppermost stream side among the RCL units 100A. The distributing unit 2000 functions as a tray supplying unit which supplies the tray TR to the conveyer line 102 of the RCL unit 100A which is located at the uppermost stream side, and includes a stopper unit 2200 which stops the movement of the tray TR to be transported from the carrying-in conveyor line 3000A of the upstream side, an identifier reader (a barcode reader) 2250, and a main control unit 2050.

Figure 2:
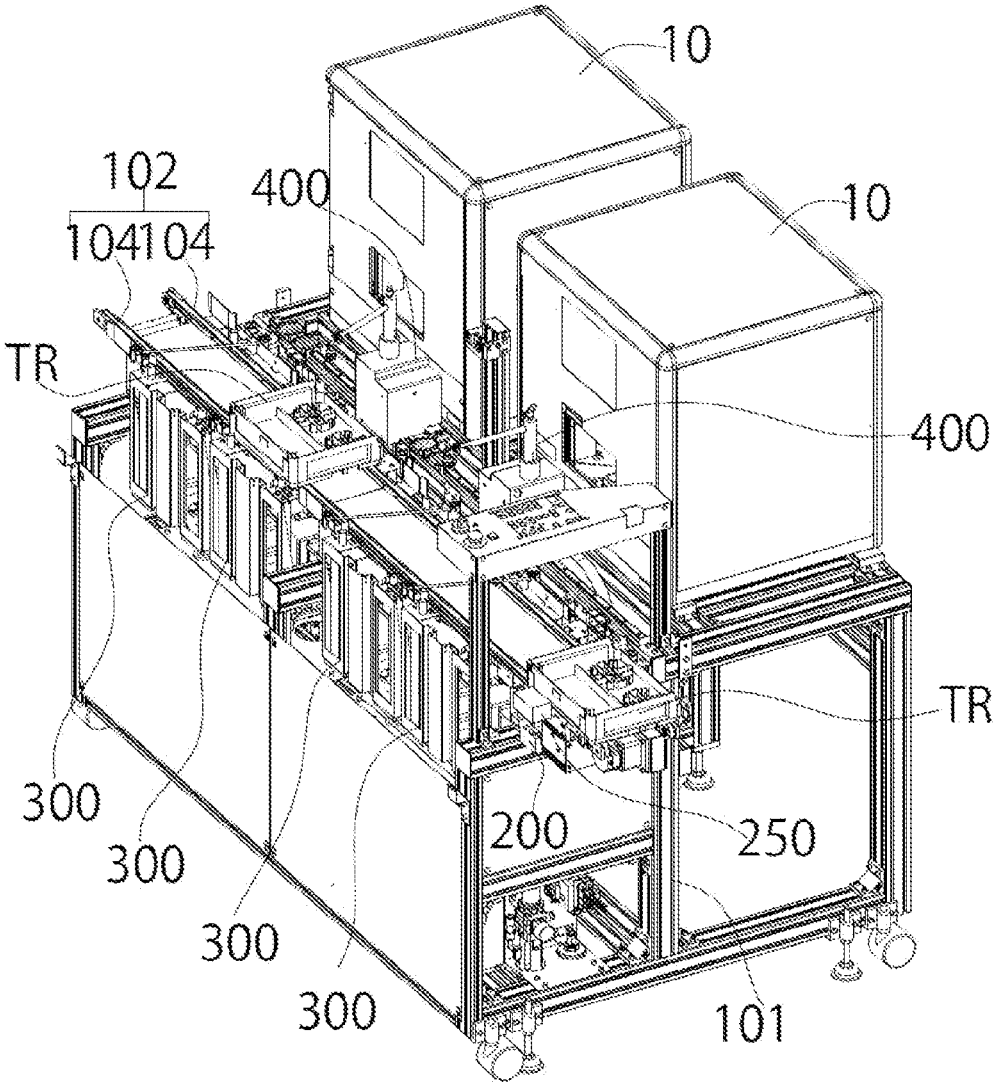
FIG. 2 is an exterior perspective view of an individual conveyor line unit 100.
Figure 3:
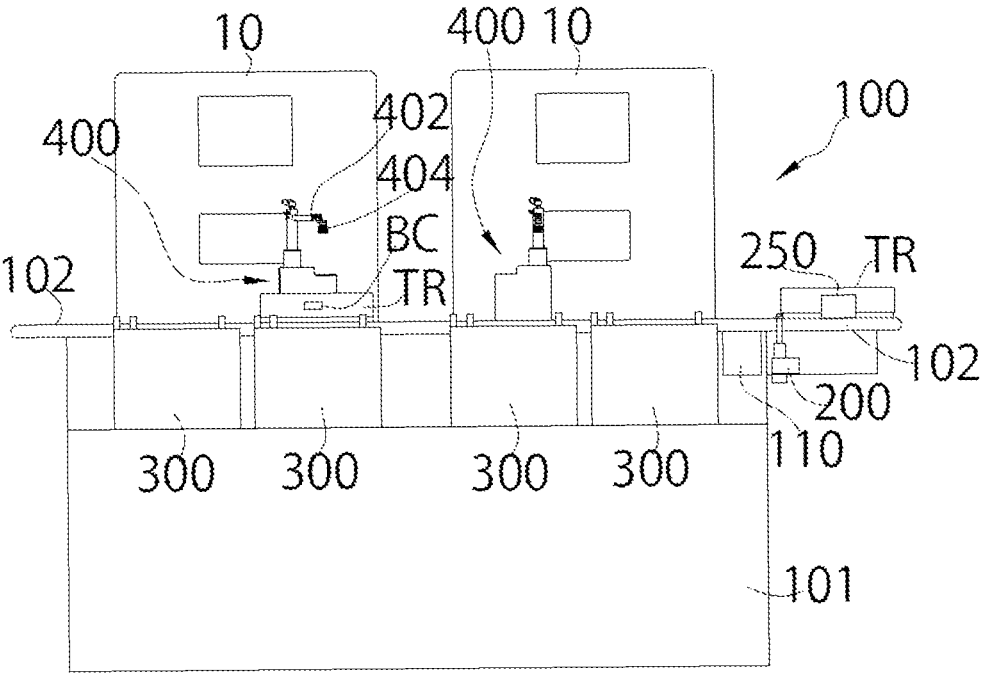
FIG. 3 is a schematic front view of the individual conveyor line unit 100.

FIG. 2 is an exterior perspective view for describing a configuration of the individual conveyor line unit 100. FIG. 3 is a schematic front view of the individual conveyor line unit 100.

The conveyor line 102 has two belts 104, and two belts 104 are concurrently transported by a driving portion 110. The conveyor line 102 may be configured by various methods such as a roller type in addition to being configured by the belt type like the present embodiment. The conveyor line 102 is arranged on the base 101. The tray TR mounted on the tray 104 is transported from the right side to the left side of FIG. 3. On the upstream side (the right side of FIG. 3) of the conveyor line 102, a stopper unit 200 which stops the movement of the tray TR on the belt 104, and an identifier reader 250 (a barcode reader) which reads a barcode BC that is an identifier attached to the tray TR, are arranged.

Figure 4A:
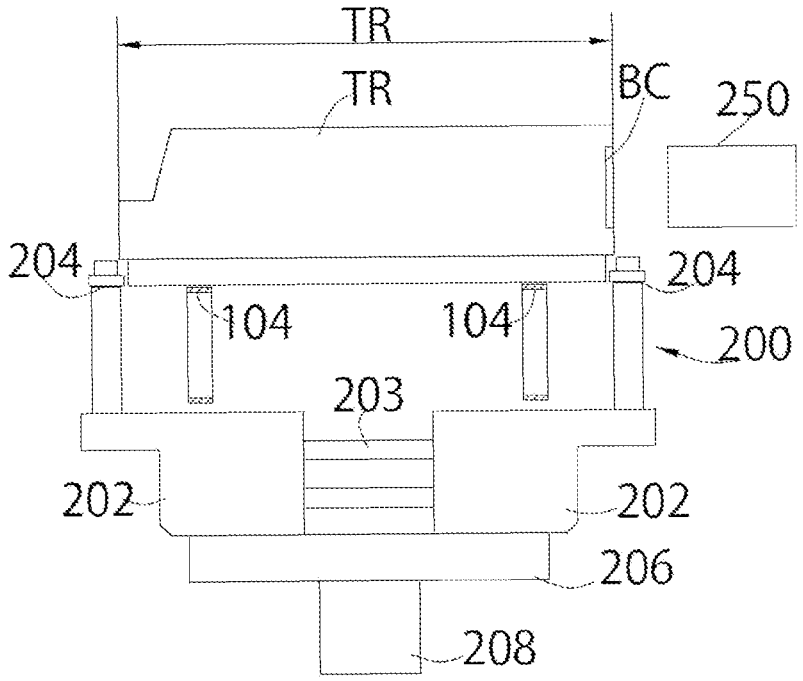
FIG. 4A is a configuration diagram of a stopper unit.
Figure 4B:
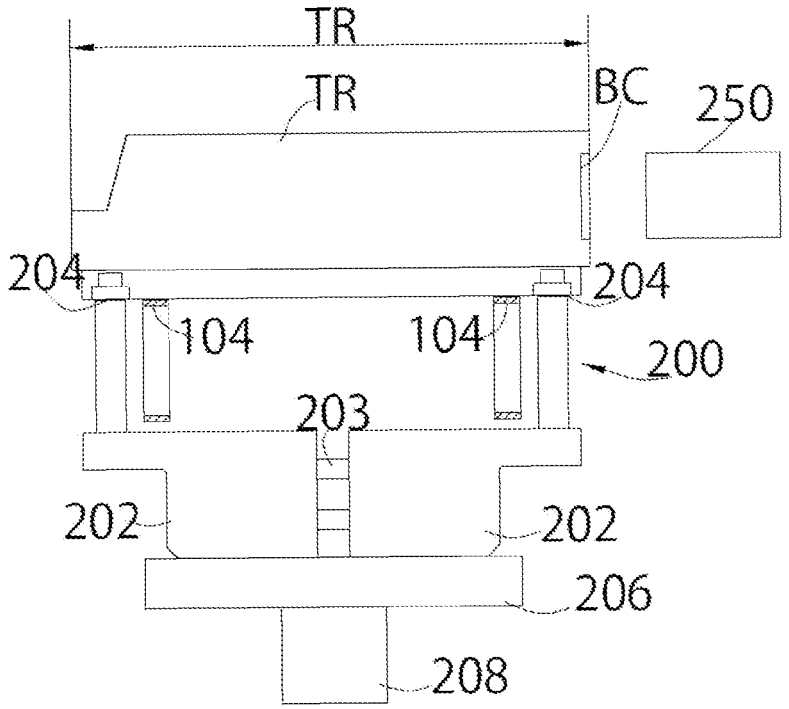
FIG. 4B is a configuration diagram of the stopper unit.

FIGS. 4A and 4B are configuration diagrams of the stopper unit 200 which are viewed (viewed from FIG. 3) from left of an advancing direction of the tray TR. The stop unit 200 has a left base 202L and a right base 202R which are held rotatably along a guide shaft 203 extended in a left and right direction of FIG. 4A (FIG. 4B). On an upper portion of the left base 202L and an upper portion of the right base 202R, stopper pins 204 vertically stand, respectively. The left base 202L and the right base 202R are moved in the left and right direction so as to approach and be separated from each other by the driving portion 206 having a motor 208. The driving portion 206 can be constituted by a known moving mechanism such as a rack and a pinion mechanism. FIG. 4A shows a state where two stopper pins 204 are opened so as to be wider than a width WY of the tray TR mounted on the belt 104. In this case, the tray TR is transported by the movement of the belt 104. FIG. 4B shows a state where two stopper pins 204 are closed so as to be narrower than a width WY (a width of a direction perpendicular to the advancing direction of the tray TR) of the tray TR. In this case, the stopper hinge 204 comes into contact with a leg portion of the tray TR, and the movement of the tray TR is stopped with respect to the movement of the tray 104.

In FIGS. 4A and 4B, an identifier reader 250, which reads the barcode BC attached to the tray TR, is concurrently shown. When the transportation of the tray TR is stopped by the stopper 200, the barcode BC is read by the identifier reader 250.

In FIGS. 2 and 3, a tray lifting unit 300 as a tray moving unit, which moves the tray TR from the upper portion of the conveyor line 104 and puts the tray TR onto the conveyor line 104 again, is arranged corresponding to the processing apparatus 10. The tray lifting unit 300 separates at least two trays TR from the conveyer line 104 for one processing apparatus, and moves it to predetermined standby positions provided for trays waiting for lens processing. In the present example, two tray lifting units 300 corresponding to one processing apparatus 10 are arranged. In FIG. 3, since two processing apparatuses are arranged with respect to the RCL unit 100, four tray lifting units 300 are arranged with respect to the RCL unit 100.

Figure 5:
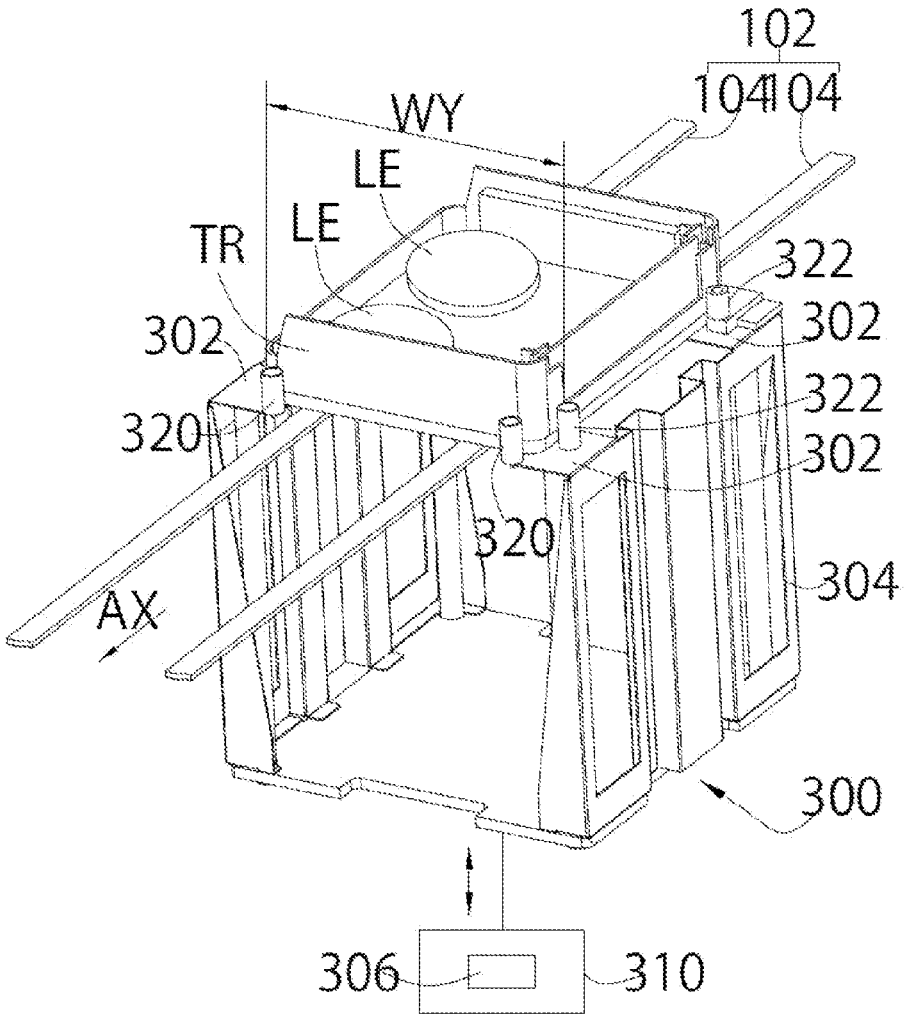
FIG. 5 is an explanatory diagram of a tray lifting unit.

FIG. 5 is an explanatory diagram of the tray lifting unit 300. The tray TR mounted on the conveyor line 102 (the belt 104) is transported in an arrow AX direction. The tray lifting unit 300 has a plate 302 on which a leg portion of a lower end of the tray TR is mounted. The plate 302 is attached to the upper portion of the base portion 304 of the vertical movement. The base portion 304 is moved in the up and down direction by a vertical moving mechanism 310 having a motor 306. The vertical moving mechanism 310 is constituted by a slide mechanism which has a transport screw connected to a rotation shaft of the motor 306, or a well known slide mechanism such as a belt type slide mechanism.

In FIG. 5, in the arrow AX direction (an advancing side of the tray TR) on the plate 302, two stopper members, 320 which stop the transportation of the tray TR, are attached with the conveyor line 102 (two belts 104) interposed therebetween. A gap between two stopper members 320 is narrower than a width WY of the tray TR. Furthermore, a contact member 322 which regulates the position of the tray TR in the width WY direction, is placed on the plate 302. The contact member 322 comes into contact with the side surface of the tray TR.

Figure 6A:
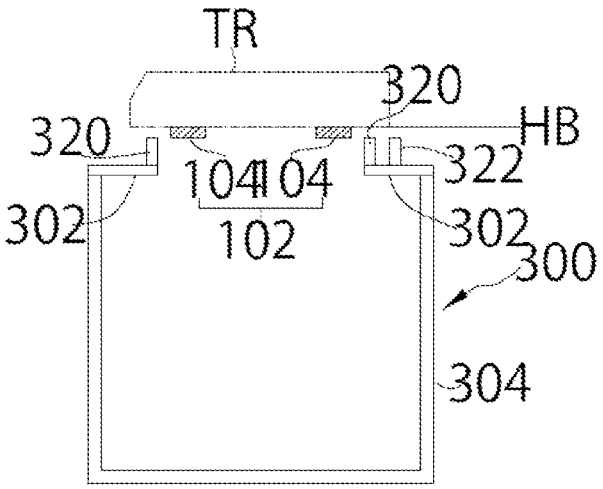
FIGS. 6A, 6B and 6C are an explanatory diagram of a vertical movement of the tray lifting unit.
Figure 6B:
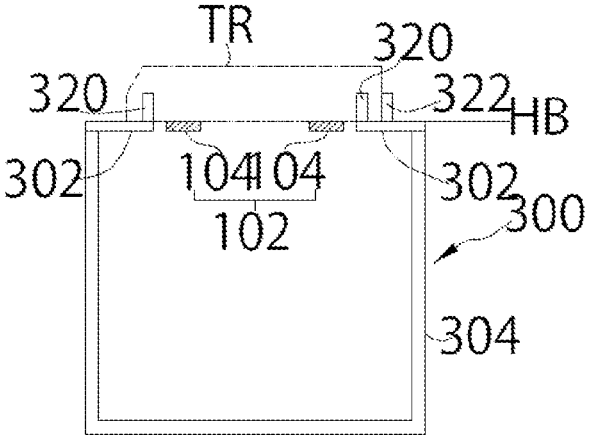
Figure 6C:
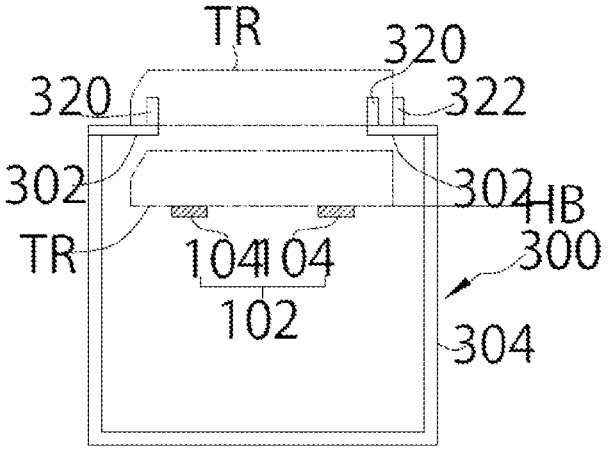

FIGS. 6A to 6C are explanatory diagrams of the vertical movement of the tray lifting unit 300. FIG. 6A shows a state where the base portion 304 is in a lowermost retracted position and an upper end of the stopper member 320 is in a position lower than a height HB of the belt 104 of the conveyor belt 102. In this case, the tray TR is not stopped when being transported by the conveyor line 102 (the belt 104), but passes through the upper portion of the tray lifting unit 300.

When stopping the tray TR transported by the conveyor line 102 (the belt 104), as shown in FIG. 6B, the plate 302 rises to the same height as the height HB of the belt 104. At this time, the stopper member 320 comes into contact with the tray TR, and the transportation of the tray TR is stopped.

FIG. 6C is a diagram of a state where the tray TR mounted on the plate 302 is separated from the upper portion of the belt 104 by raising the plate 302 with respect to FIG. 6B. The plate 302 rises to a predetermined position higher than the height of the tray TR transported by the belt 104. As a result, it is possible to cause the tray TR transported by the belt 104 to pass through.

In FIGS. 2 and 3, between the processing apparatus 10 and the conveyor line 102, the lens LE is taken out from tray TR and is moved to the processing apparatus 10, the lens LE processed by the processing apparatus 10 is taken out from the processing apparatus 10, and a robot 400 is placed as a lens moving unit for moving to tray TR again. The robot 400 is constituted by the same mechanism as a robot hand unit disclosed in JP-A-2004-34167. The robot 400 is moved in the left and right direction of FIG. 3 along a rail extended in parallel to the belt 104. The robot 400 has an arm 402 moved and rotated vertically, and an adsorption portion 404 which adsorbs the lens LE is attached to a tip of the arm 402. The lens LE on the tray TR is held by the adsorption portion 404 and is moved to a lens chuck included in the processing apparatus 10 by the movement of the robot 400.

At least one robot 400 may be provided in the RCL unit 100. In FIGS. 2 and 3 of the present embodiment, two robots 400 are provided in the RCL unit 100. The lens LE is effectively moved between the tray TR and the processing apparatus 10 by two robots 400.

Figure 7:
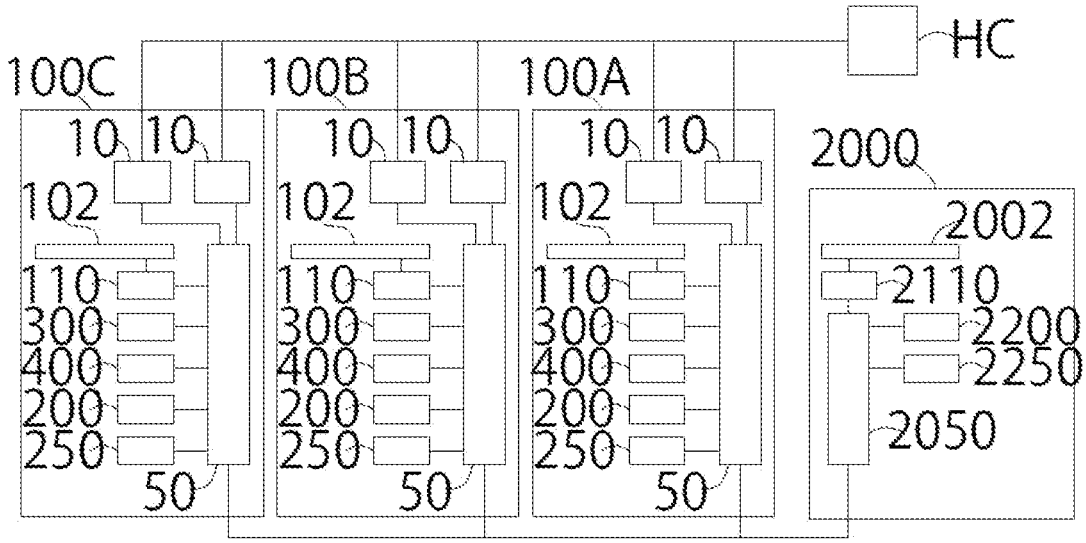
FIG. 7 is a control block diagram of the eyeglass lens supplying system.

FIG. 7 is a control block diagram of the eyeglass lens supplying system 1000. The RCL unit 100 includes an individual control unit 50. The individual control unit 50 is connected to the processing apparatus 10, the driving portion 110 of the conveyor line 102, the stopper unit 200, the identifier reader 250, the tray lifting unit 300, and the robot 400, sends the control signal to those components, and controls those components.

The RCL unit 100 having the configuration as described above has the same configuration as that of the individual conveyor line unit indicated by reference numerals 100A, 100B, and 100C. For this reason, in the RCL units 100B and 100C, only the individual control unit 50 is shown, and other configurations are omitted.

The individual control unit 50 included in each RCL unit 100 is connected to a main control unit 2050 included in the distributing unit 2000. The distributing unit 2000 includes a stopper unit 2200 having the same configuration as that of the stopper unit 200 of FIGS. 4A and 4B. Furthermore, the distributing unit 2000 includes an identifier reader 2250 that reads the barcode BC attached to the tray TR. The driving portion 2110, the stopper unit 2200, and the identifier reader 2250 of the conveyor line 2002 are connected to the main control unit 2050. Furthermore, the processing apparatus 10 is connected to the host computer HC. In the host computer HC, a processing condition data of the lens LE corresponding to a processing number is stored. The processing numbers of the pair of left and right lenses LE are assigned to the barcode BC. The barcode BC assigned with the processing number is attached to the tray TR. The barcode BC obtained by the individual control unit 50 is transmitted to the processing apparatus 10. The processing apparatus 10 obtains the processing condition data such as a bead form corresponding to the barcode BC from the host computer HC. The peripheral edge of the lens LE is processed according to the processing condition data by the processing apparatus 10.

In the eyeglass lens supplying system 1000 as mentioned above, the operation thereof will be described. The carrying-in conveyor line 3000A is mounted with the tray TR with a non-processed lens LE placed thereon. The tray TR is moved to the conveyor line 2002 of the distributing unit 2000. The main control unit 2050 operates the stopper unit 2200 to temporarily stop the movement of the tray TR, and reads the barcode of the tray TR by the identifier reader 2250.

Herein, in the memory included in the main control unit 2050, a number (in an example of FIG. 1, three RCL units 100A, 100B, and 100C) of the RCL units 100 connected to the downstream side, and a number (that is, a number of the tray lifting units 300 included in the respective RCL unit 100) of the trays TR capable of being received in the respective RCL units 100 are registered. Furthermore, when the tray TR does not exist on the standby position of the tray lifting unit 300, and the tray lifting unit 300 is able to receive (carry in) a new tray TR, the control unit 50 of the RCL unit 100 transmits a request signal requesting the tray TR to the main control unit 2050. When the request signal of the tray TR is input from the control unit 50 of each RCL unit 100, the main control unit 2050 determines the RCL unit 100 of a carrying-out destination of the tray TR having the barcode which is read by the identifier reader 2250, and then, transmits the signal of the read barcode to the control unit 50 of the RCL unit 100 of the determined carrying-out destination.

In an initial step, the tray TR can be moved to each standby position of any tray lifting unit 300 in the entire RCL unit 100. The respective control unit 50 sends the request of the number of the tray lifting unit 300 included in the RCL unit 100 for which it is responsible to the main control unit 2050. The main control unit 2050 communicates with each control unit 50, and determines the RCL unit 100 to which the tray TR on the carrying-in conveyer line 3000A based on the request. Alternatively, the main control unit 2050 may determine the processing apparatus 10 which processes the lens in the tray of the carrying-in conveyer line 3000A. The main control unit 2050 sends a signal of a barcode BC which is the identification information attached to the tray TR to the control unit of each RCL unit 100. For example, the main control unit 2050 determines the RCL unit 100 of the carrying-out destination so as to sequentially transport the tray TR from the lowest RCL unit 100C. That is, the main control unit 2050 distributively transports the first tray TR to the RCL unit 100C, and transmits the signal of the barcode read by the reader 2250 to the control unit 50 of the unit 100C. After that, the main control unit 2050 opens the stopper pin 204 of the stopper unit 2200, and supplies the tray TR to the RCL unit 100A of the downstream side. Next, the control unit 2050 closes the stopper pin 204 of the stopper unit 2200 in order to read the barcode BC of the second tray TR.

In each RCL unit 100, a reader 250 reads the barcode BC which is the identification information of the tray TR which is conveyed from the upstream. The control unit 50 moves the tray TR to the standby position by the tray lifting unit 300 if the read identification information matches with the sent identification information. On the other hand, the control unit 50 sends the tray TR to the downstream side RCL unit 100 if the read identification information does not matches with the sent identification information. Specific process will de described below.

The control unit 50 of the RCL unit 100A stops the movement of the first tray TR by the stopper unit 200, and reads the barcode BC by the reader 250. Since there is no tray TR distributed to the RCL unit 100A, the control unit 50 of the RCL unit 100A opens the stopper unit 200 by the reading of the barcode BC, and causes the tray TR to pass through. The control unit 50 of the next RCL unit 100B also stops the movement of the first tray TR by the stopper unit 200, and reads the barcode BC by the reader 250. Like the case of the RCL unit 100A, since there is no tray TR distributed to the unit 100B, the control unit 50 of the RCL unit 100A also opens the stopper unit 200 by the reading of the barcode BC and causes the tray TR to pass through.

The control unit 50 of the unit RCL 100C stops the movement of the first tray TR by the stopper unit 200, and reads the barcode BC by the reader 250. Moreover, when it is determined that there is a tray TR assigned to the RCL unit 1000 by the reading of the barcode BC, the control unit 50 operates one of four tray lifting units 300 so as to process the lens LE of the tray TR by the processing apparatus 10. Firstly, the tray lifting unit 300 of the downstream side corresponding to the processing apparatus 10 is operated so as to process the lens LE by the processing apparatus 10 of the downstream side.

As shown in FIG. 6B, the control unit 50 raises the plate 302 to a position of the height HB, whereby the stopper member 320 is moved to a position higher than the belt 104, and the tray TR transported by the belt 104 is stopped. After that, the plate 302 is further raised. As a result, as shown in FIG. 6C, the tray TR is mounted on the plate 302 and is moved to the standby position of a predetermined height. When the tray TR mounted on the tray lifting unit 300 is situated at the predetermined standby position, the control unit 50 of the RCL unit 100C operates the robot 400, and moves one of the left and right lenses LE placed on the plate TR to the processing apparatus 10 of the downstream side. After that, the control unit 50 sends the processing command and the operation number of the barcode BC to the processing apparatus 10, and starts the processing of the lens LE. The processing apparatus 10 sends the operation number of the barcode BC to the host computer HC, and requests the processing condition data. The host computer HC transmits the processing condition data corresponding to the operation number to the processing apparatus 10. As a result, the peripheral edge processing of the lens LE is performed based on a predetermined processing condition corresponding to the operation number.

Furthermore, the main control unit 2050 of the distributing unit 2000 distributes the second tray TR to the RCL unit 100B, and distributes the third tray TR to the RCL unit 100A, by the request from each control unit 50 of the RCL units 100B and 100A. Since the second tray TR is distributed to the RCL unit 100B, when the control unit 50 of the RCL unit 100A reads the barcode BC of the second tray TR like the previous description, the control unit 50 opens the stopper unit 200 and sends the same to the RCL unit 100B side. When the control unit 50 of the RCL unit 100B operates the stopper unit 200 to read the barcode BC of the second tray TR, since the tray TR is distributed to its own unit RCL 100B, like the case of the RCL unit 1000, the control unit 50 operates the tray lifting unit 300 of the downstream side. Moreover, the control unit 50 of the RCL unit 100B stops the movement of the second tray TR transported by the belt 104, then raises the plate 302, and moves the tray TR to a predetermined position. After that, the robot 400 and the processing apparatus 10 are operated.

When the third tray TR is transported to the conveyor line 102 of the RCL unit 100A, the control unit 50 of the unit 100A identifies that the tray TR is distributed to the own RCL unit 100A by the operation of the stopper unit 200 and the reader 250. Moreover, like the previous description, the control unit 50 of the RCL unit 100A operates the tray lifting unit 300 of the downstream side, moves the tray TR to a predetermined position, and then, operates the robot 400 and the processing apparatus 10.

After that, similarly, the distributing destination of the tray TR transported to the conveyor line 2002 of the distributing unit 2000 is sequentially determined by the main control unit 2050 received the request signal from the respective control units 50. When there is no tray TR distributed to its own RCL unit 100, the respective control units 50 of the RCL units 100A, 100B, and 100C do not operate the tray lifting unit 300 but causes the tray TR to pass through to send it to the downstream conveyer line 102 or the carrying out conveyer line 3000B. When the tray TR distributed to its own RCL unit 100 is transported, the control unit 50 determines the tray lifting unit 300 on which the tray TR can be moved to the standby position, operates the tray lifting unit 300, and causes the tray TR to leave from the conveyor line 102.

In addition, the pair of left and right lenses LE is placed on the tray TR. The unprocessed lenses LE which is put in the tray TR are moved by the robot 400 to the processing apparatus 10 so that the pair of left and right lenses LE is processed by the same processing apparatus 10. The processing apparatus 10 sends a completion signal to the control unit 50 if the processing of the lens LE is completed. The control unit 50 operates the robot 4500 and return the lens LE processed by the processing apparatus to the original tray TR. If one of the right and left of the lenses LE has not yet been processed and is put in the tray TR, the robot 400 operates, and moves the unprocessed lens LE to the processing apparatus 10. If the both right and left processed lenses LE are returned to the tray TR, the tray lifting unit 300 operates and puts the tray TR on the conveyer line 102.

Furthermore, two tray lifting units 300 are prepared for one processing apparatus 10. For this reason, it is possible to move the tray TR to the standby position and transit to the processing of the lens LE in the tray TR prepared by the second tray lifting unit 300, without waiting for the exchange of the tray TR containing the processed lens LE with the next tray TR. That is, after the processing of the lens LE in the tray TR moved to the first standby position by the first tray lifting unit 300 is finished, while exchanging the tray TR in the first tray lifting unit 300, the lens in the tray TR moved to the second standby position by the second tray lifting unit is processed by the processing apparatus. During this processing, the tray TR is moved from the first standby position to the conveyer line 102. If the first standby position can receive the tray TR, next tray TR (tray in which unprocessed lenses are put) conveyed by the conveyer line 102 is moved to the first standby position, and waits at the first standby position. Then, if the processing of the lens LE in the tray TR at the second standby position is completed, the lens LE in the tray TR waiting at the first standby position is processed. As a result, the operating efficiency of the processing apparatus 10 can be increased, and the lens LE is effectively processed.

When the pair of left and right lenses LE in the tray TR at the standby position is processed, the tray 302 descends, and the tray TR is mounted on the belt 104 of the conveyor line 102. As a result, the tray TR is transported to the carrying-out conveyor line 3000B of the downstream side.

When the plate 302 of the tray lifting unit 300 is moved to the lowest retracted position, the control unit 50 sends the request signal indicating that it is prepared for receiving the next tray TR to the standby position of the main control unit 2050. When receiving the request signal of the reception of the tray TR from the control unit 50 of the respective units 100, the main control unit 2050 sequentially determines the distributing destination of the tray TR in which the transportation is stopped by the stopper unit 2200. Then, the main control unit 2050 cancels the stop of the stopper unit 2200 and supplies the tray TR to the uppermost stream conveyer line 102. When there is no request signal from the respective control units 50, the transportation of the tray TR is stopped by the stopper unit 220, and the tray TR waits in the conveyor line 2002 of the distributing unit 2000 and the carrying-in conveyor line 3000A.

As mentioned above, since the conveyor lines 102 each included in the plurality of RCL units 100 are arranged in series between the carrying-in conveyor line 3000A and the carrying-out conveyor line 3000B, a reduction in installation space of the eyeglass lens supplying system 1000 is promoted. Furthermore, the conveyer line 102 having the plurality of RCL units 100 are connected in series each other to form substantially one conveyer line, and further the operating process such as the transportation of the tray TR of the respective RCL units 100 are performed by the individual control unit 50 provided in each unit 100. Thus, there is no need for a large-scale control program for synthesizing the entire system 1000. Since a simple registration of the number of the RCL units 100 or the like is performed in the main control unit 2050, even if the number of the RCL units 100 fluctuates by a desire of a user, it is possible to easily cope with the fluctuation. For this reason, it is possible to build an economically advantageous press supplying system with respect to a desire of a user without increasing the cost.

In addition, it is possible to cause the RCL unit 100A situated uppermost stream to have a function of the distributing unit 2000 and omit the distributing unit 2000. That is, the stopper unit 200 provided in the RCL unit 100A also functions as the stopper unit 2200, and the reader 250 provided in the RCL unit 100A also functions as the reader 2250. Furthermore, the control unit 50 of the RCL unit 100A takes a role of the function of the main control unit 2050. In this manner, the present invention can be variously modified, and the modifications are included in the present invention in the range of the same technical idea.

The conveyer line 102 shown in FIG. 2 is designed so that the conveyer line 102 has two function of carrying-in the tray TR in which unprocessed lens are put and carrying-out the tray TR in which processed lens are put. The conveyer line for conveying the tray TR in which the processed lens is put can be provided separately from the conveyer line for conveying the tray TR in which the unprocessed lens in put. For example, as shown in FIG. 2, a first conveyer line 102 for conveying the tray in which the unprocessed lens is put and a second conveyer line 102 for conveying the tray in which the processed lens is put are arranged in parallel to each other and provided for each RCL unit 100. The second conveyers of each RCL unit 100 are also connected in series to form substantially one conveyer line. The tray moving unit (tray lifting unit 300) is controlled so that the tray TR in which the processed lens is put is placed on the second conveyer line. With this arrangement, the tray in which the unprocessed lens is put and the tray in which the processed lens is put are smoothly conveyed.

Further, in each conveyer line nit 100 (100A, 100B, 100C), the stopper unit 200 may not be operated when reading the identification information of the tray TR by the reader 250. By reading the barcode BC by the reader 250 while the tray TR is moving, the conveying time can be made short.

What is claimed is:

1. An eyeglass lens supplying system for supplying an eyeglass lens to a plurality of eyeglass lens processing apparatus comprising:

a plurality of conveyer line units, each of which includes:

at least one conveyer line configured to convey a tray in which the lens is put;

a base on which at least one processing apparatus and the conveyer line are disposed;

a tray moving unit configured to separate at least two trays from the conveyer line for one processing apparatus to move the trays to standby positions, respectively, and put the tray in which processed lens is put on the conveyer line;

a robot configured to supply the lens in the tray at the standby position to the processing apparatus and return the processed lens to the tray; and a control unit configured to obtain identification information to obtain processing information from a host computer;

a carrying-in conveyer line connected to the conveyer line of the conveyer line unit which is located at a uppermost stream side;

a carrying-out conveyer line connected to the conveyer line of the conveyer line unit which is located at a downmost streamside;

a main control unit configured to communicates with each of the control units, and determines the processing apparatus to process the lens in the tray on the carrying-in conveyer unit, or determines the conveyer line unit to convey the tray on the carrying-in conveyer unit, wherein the conveyor lines of the plurality of conveyer line units are connected so as to form substantially one conveyer line when the plurality of conveyer line units are arranged.

2. The eyeglass lens supplying system according to claim 1, wherein if the standby position can receive the tray, the corresponding control unit sends a signal for request the tray to the main control unit, and if receiving the request signal, the main control unit determines the conveyer line unit as a carrying-out destination of the tray and supplies the tray to the conveyer line of the conveyer line unit at the uppermost stream side.

3. The eyeglass lens supplying system according to claim 2 further comprising a stopper unit configured to stop conveying of the tray by the carrying-in conveyer unit, the stopper unit is disposed at the upstream side of the uppermost upper stream side conveyer line, wherein when receiving the request signal, the main control unit cancels stopping of the stopper unit and supplies the tray to the uppermost stream side conveyer line.

4. The eyeglass lens supplying system according to claim 2, wherein a first reader for reading the identification information of the tray on the carrying-in conveyer line is provided at an upstream side of the conveyer line of the uppermost stream side conveyer line unit, a second reader for reading the identification information of the conveyed tray is provided at each of the conveyer line units, the main control unit sends the identification information read by the first reader to the control unit of the conveyer line unit which is determined as the carrying-out destination, the control unit of each of the conveyer lint unit:

operates the tray moving unit to moves the tray to the standby position if the identification information sent from the main control unit matches with the identification information read by the second reader; and does not operate the tray moving unit and send the tray to the downstream side conveyer line if the identification information sent from the main control unit does not matches with the identification information read by the second reader.

5. The eyeglass lens supplying system according to claim 1, wherein if the robot returns the processed lens to the tray at the standby position, the robot supplies the lens in the tray at the other standby position to the processing apparatus, if the robot returns the processed lens to the tray, the tray moving unit puts the tray on the conveyer line, if the standby position can receive the tray, the corresponding control unit sends a signal for request the tray to the main control unit, and if receiving the request signal, the main control unit determines the conveyer line unit as a carrying-out destination of the tray and supplies the tray to the conveyer line of the conveyer line unit at the uppermost stream side.

6. The eyeglass lens supplying system according claim 1, wherein the conveyer line of each of the conveyer line units includes a first conveyer line for conveying the tray in which the unprocessed lens is put and a second conveyer line for conveying the tray in which the processed lens in put, and the tray moving unit put the tray in which the processed lens is put on the second conveyer line.

7. An eyeglass lens supplying system for supplying an eyeglass lens to a plurality of eyeglass lens processing apparatus comprising:

a plurality of conveyer line units, each of which includes:

at least one conveyer line configured and computer controlled to convey a tray in which the lens is put;

a base on which at least one processing apparatus and the conveyer line are disposed;

a tray moving unit configured and computer controlled to separate at least two trays from the conveyer line for one processing apparatus to move the trays to standby positions, respectively, and put the tray in which processed lens is put on the conveyer line;

a robot configured and computer controlled to supply the lens in the tray at the standby position to the processing apparatus and return the processed lens to the tray; and a control unit that obtains identification information to obtain processing information from a host computer;

a carrying-in conveyer line connected to the conveyer line of the conveyer line unit which is located at a uppermost stream side;

a carrying-out conveyer line connected to the conveyer line of the conveyer line unit which is located at a downmost streamside;

a main control unit that communicates with each of the control units, and determines the processing apparatus to process the lens in the tray on the carrying-in conveyer unit, or determines the conveyer line unit to convey the tray on the carrying-in conveyer unit, wherein the conveyor lines of the plurality of conveyer line units are connected so as to form substantially one conveyer line when the plurality of conveyer line units are arranged.

* * * * *